US008757446B1

(12) United States Patent
Liu

(10) Patent No.: US 8,757,446 B1
(45) Date of Patent: Jun. 24, 2014

(54) FLUID SUPPLYING DEVICE

(71) Applicant: Cosda Manu facturing Company, Taichung (TW)

(72) Inventor: Lai-Cheng Liu, Taichung (TW)

(73) Assignee: Cosda Manu Facturing Company, Taichung (TW)

( * ) Notice: Subject to any disclaimer, the term of this patent is extended or adjusted under 35 U.S.C. 154(b) by 43 days.

(21) Appl. No.: 13/738,404

(22) Filed: Jan. 10, 2013

(51) Int. Cl.
*B67B 1/00* (2006.01)

(52) U.S. Cl.
USPC ..... 222/153.04; 222/153.13; 222/384; 222/399; 222/400.8; 222/402; 222/469

(58) Field of Classification Search
CPC ..... B67D 7/12; B67B 1/00; B65D 83/00
USPC ..... 222/74–75, 153.04, 153.11–153.14, 222/399, 401, 402, 468–470, 400.5, 222/400.7–400.8, 384–385, 402.11
See application file for complete search history.

(56) References Cited

U.S. PATENT DOCUMENTS

| | | | | |
|---|---|---|---|---|
| 4,192,464 | A * | 3/1980 | Chow | 239/373 |
| 4,782,982 | A * | 11/1988 | Ellison | 222/1 |
| 5,251,787 | A * | 10/1993 | Simson | 222/95 |
| 6,170,706 | B1 * | 1/2001 | Havlovitz | 222/109 |
| 6,701,975 | B1 * | 3/2004 | Neal | 141/18 |
| 2007/0175928 | A1 * | 8/2007 | Arcuri et al. | 222/401 |
| 2011/0057436 | A1 * | 3/2011 | Schrum et al. | 285/33 |

* cited by examiner

*Primary Examiner* — Paul R Durand
*Assistant Examiner* — Andrew P Bainbridge

(57) ABSTRACT

A fluid supplying device of the present invention includes a reservoir, an outer tube, an inner tube disposed in the outer tube, a pressing rod, and a positioning handle. The outer tube disposed in the reservoir and is partially exposed outside the reservoir. The pressing rod is slidably disposed in the inner tube. The positioning handle is pivotably disposed to the reservoir and is able to altervatively abut against the pressing rod to prevent the pressing rod from moving. The reservoir forms a relief hole, and the positioning handle forms a through hole. When the pressing rod is restricted by the positioning handle, the relief hole is deviated from the through hole, and vice versa. Thereby, the present invention can prevent gas-leakage and prevent the pressing rod from bouncing up.

5 Claims, 5 Drawing Sheets

FLUID SUPPLYING DEVICE

BACKGROUND OF THE INVENTION

1. Field of the Invention

The present invention relates to a fluid supplying device.

2. Description of the Prior Art

A conventional fluid supplying device has a reservoir for receiving fluid and is driven by manually pumping up or by gas filled into the reservoir for pushing fluid out.

Some fluid supplying devices can be operated in gas-mode or manually alternatively. However, when operated manually, the reservoir has to communicate with exterior to allow a pressing rod to pumping up. Thus, the reservoir must form a relief hole or other similar structure. On the contrary, when operated in gas-mode, there is no necessity to slide the pressing rod, so the relief hole is unnecessary. In addition, the relief hole may result gas-leakage so that the fluid is difficult to be extracted out. Thus, the relief hole should be closed in advance.

On the other hand, when operated in gas-mode, the pressing rod may bounce up due to the input gas. The bouncing pressing rod may be dangerous. Even if a positioning device is disposed to position the pressing rod, the pressing rod may bounce up when a user forgets to position it.

SUMMARY OF THE INVENTION

The main object of the present invention is to provide a fluid supplying device which is able to be operated by gas-mode or manually, and the fluid supplying device can block relief hole and prevent pressing rod from bouncing up at the same time.

To achieve the above and other objects, a fluid supplying device of the present invention includes a reservoir, a cover, an outer tube, an inner tube, a pressing rod, and a positioning handle.

The reservoir has an opening at o top thereof and a gas inlet. The top of the reservoir further forms a relief hole. The cover is disposed at the opening and is hollow. A side of the cover forms a fluid outlet. An end of the outer tube extends into the reservoir, and an opposite end of the outer tube extends outside the reservoir through the cover. The outer tube communicates with the fluid outlet. The inner tube is disposed in the outer tube, and an end of the inner tube also extends through the cover. The pressing rod is slidably disposed in the inner tube, and an end of the pressing rod away from the reservoir extends outside the cover. An end of the positioning handle is pivotably disposed to the top of the reservoir and is able to pivot between a first position and a second position. The positioning handle further forms a through hole.

When the positioning handle is located at the first position, an end of the positioning handle away from the reservoir abuts against the end of the pressing rod away from the reservoir so that the pressing rod is unable to move along the inner tube. Also, the through hole is positionally deviated from the relief hole so that the relief hole does not communicate inside the reservoir and exterior therebetween. On the contrary, when the positioning handle is located at the second position, the end of the positioning handle away from the reservoir is away from the pressing rod and does not block the pressing rod so that the pressing rod is able to move along the inner tube. Also, the through hole positionally corresponds to the relief hole so that the relief hole communicates with exterior via the through hole.

That is, when the positioning handle is located at the first position, the reservoir does not communicate with exterior, and the pressing rod is unmovable. Thus, when gas enters the reservoir via the gas inlet, fluid in the reservoir is sucked out via the outer tube and the fluid outlet. Due to the positioning handle blocking the pressing rod, the pressing rod may not bounce up when gas enters the reservoir. On the other hand, when the positioning handle is located at the second position, the reservoir communicates with exterior, and the pressing rod is not blocked by the positioning handle so that the pressing rod is able to be slid to suck fluid into the inner tube and then to push the fluid in the inner tube into the outer tube. Thus, the fluid in the outer tube can further flow out via the fluid outlet.

Thereby, the fluid supplying device of the present invention can be operated in gas-mode or manually. Moreover, the relief hole can be closed and the pressing rod can be blocked and be prevented from bouncing up at the same time by a simple operation when the fluid supplying device is operated in gas-mode. Thus, convenience and safety are achieved.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
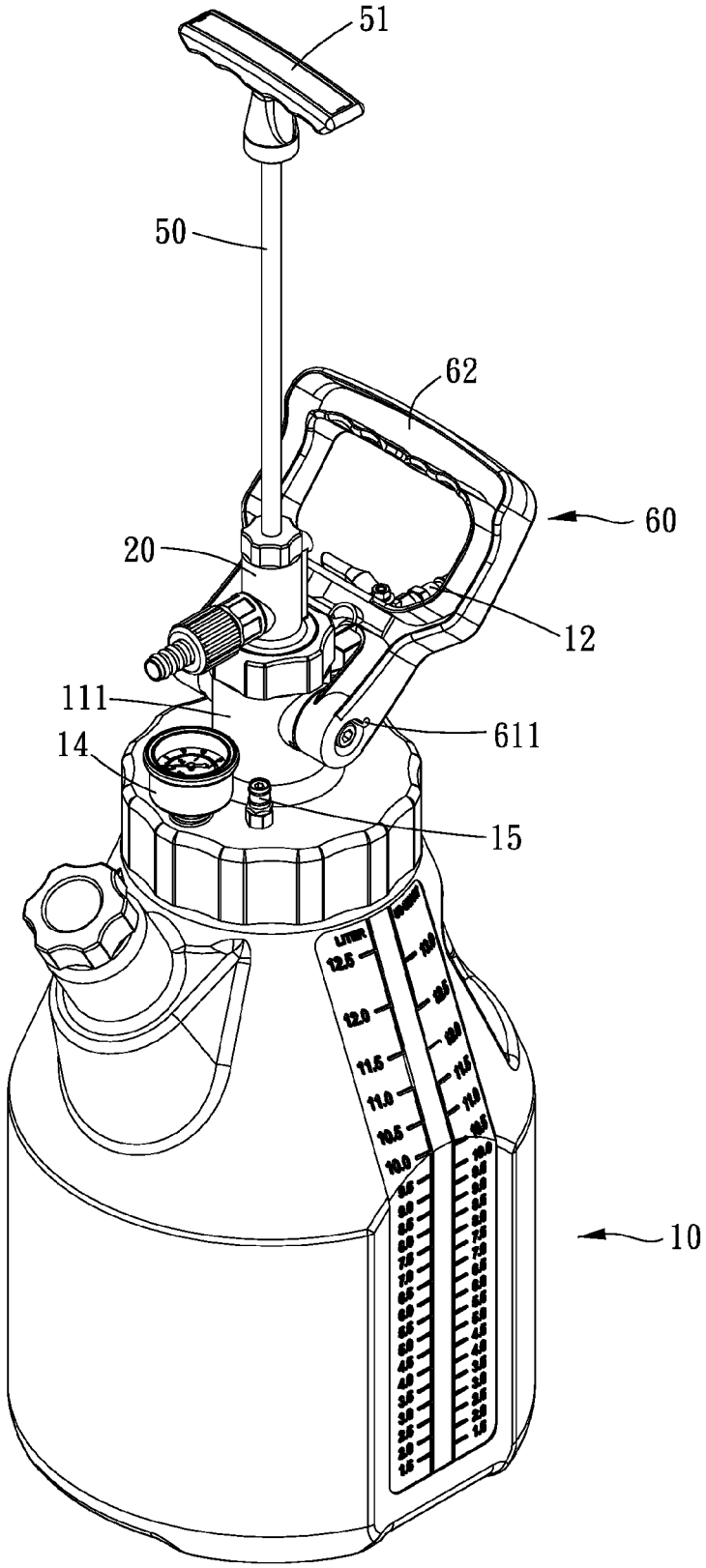
FIG. 1 is a stereogram of the present invention.
Figure 2:
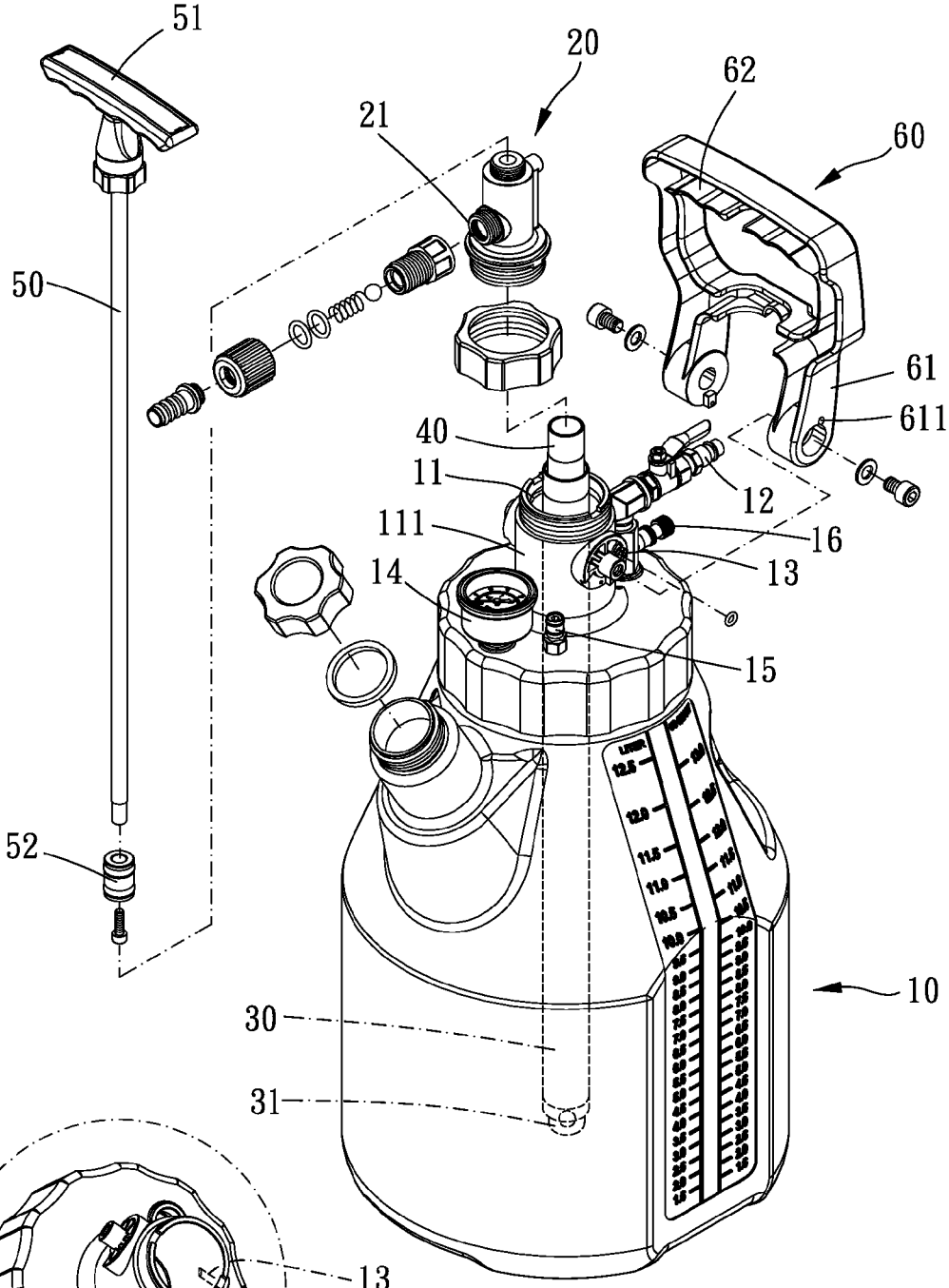
FIG. 2 is a breakdown drawing of the present invention.
Figure 2A:
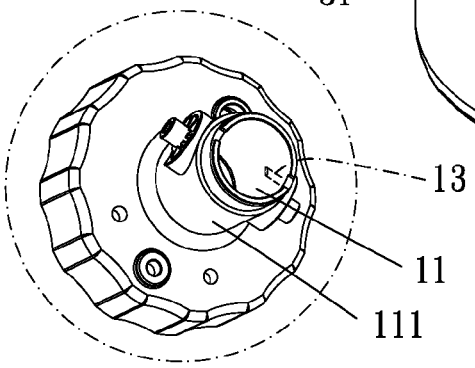
FIG. 2A is partial enlargement of a reservoir of the present invention.

Please refer to FIG. 1, FIG. 2 and FIG. 2A. The fluid supplying device of the present invention includes a reservoir 10, a cover 20, an outer tube 30, an inner tube 40, a pressing rod 50, and a positioning handle 60.

The reservoir 10 has an opening 11 and a gas inlet 12. The opening 11 is located at a top of the reservoir 10. A switch is disposed at the gas inlet 12 for alternatively allow the gas inlet 12 to communicate inside the reservoir 10 and exterior therebetween. The top of the reservoir 10 further forms relief hole 13. In the present embodiment, an annular flange 111 is formed at the opening 11 and extends outward from the opening, and the relief hole 13 is formed on the annular flange 111. Optionally, the reservoir 10 has a pressure gauge 14, an automatic safety valve 15, and a pressure-regulating valve 16. The pressure gauge 14 indicates gas pressure inside the reservoir 10, and the automatic safety valve 15 is able to release gas outward automatically when the gas pressure inside the reservoir 10 exceeds a safety limit. The pressure-regulating valve 16 is utilized for regulating gas flow entering the reservoir 10 via the gas inlet 12.

The cover 20 is disposed at the opening 11 of the reservoir and is hollow. A side of the cover 20 forms a fluid outlet 21. In the present embodiment, the cover 20 is screwed to the opening 11 of the reservoir and is disposed in a space enclosed by the annular flange 111.

An end of the outer tube 30 extends into the reservoir 10, and an opposite end of the outer tube 30 extends outside the reservoir 10 into the cover 20 via the opening 11. The outer tube 30 communicates with the fluid outlet 21. The inner tube 40 is disposed in the outer tube 30, and an end of the inner tube 40 also extends into the cover 20. Specifically, the outer tube 30 has a one-way valve 31 allowing fluid to enter the outer tube 30 from the reservoir 10 but not to flow back to the reservoir 10. Preferably, the one-way valve 31 is a movable ball disposed in the outer tube 30.

The pressing rod 50 is slidably disposed in the inner tube 40. An end of the pressing rod 50 away from the reservoir 10 extends outside the cover 20. In the present embodiment, the end of the pressing rod 50 away from the reservoir 10 has a handgrip 51, and an end of the pressing rod 50 away from the handgrip 51 has a piston 52 for facilitating suction.

An end of the positioning handle 60 is pivotably disposed to the top of the reservoir 10. The positioning handle 60 is able to pivot between a first position and a second position. The positioning handle 60 further forms a through hole 611. In the present embodiment, the positioning handle 60 is pivotably disposed to the annular flange 111. Preferably, the positioning handle 60 has a first end and a second end, and two parallel pivot arms 61 arranged spacedly are formed at the first end of the positioning handle 60. The two pivot arms 61 are pivotably disposed to two opposite sides of the annular flange 111 respectively, and the through hole 611 is formed on one of the pivot arms 61. A restriction groove 62 facing the pressing rod 50 is formed at the second end of the positioning handle 60, and circumferential walls of the restriction groove 62 extend to the two pivot arms 61 so that the positioning handle 60 is substantially U-shaped.

Figure 3:
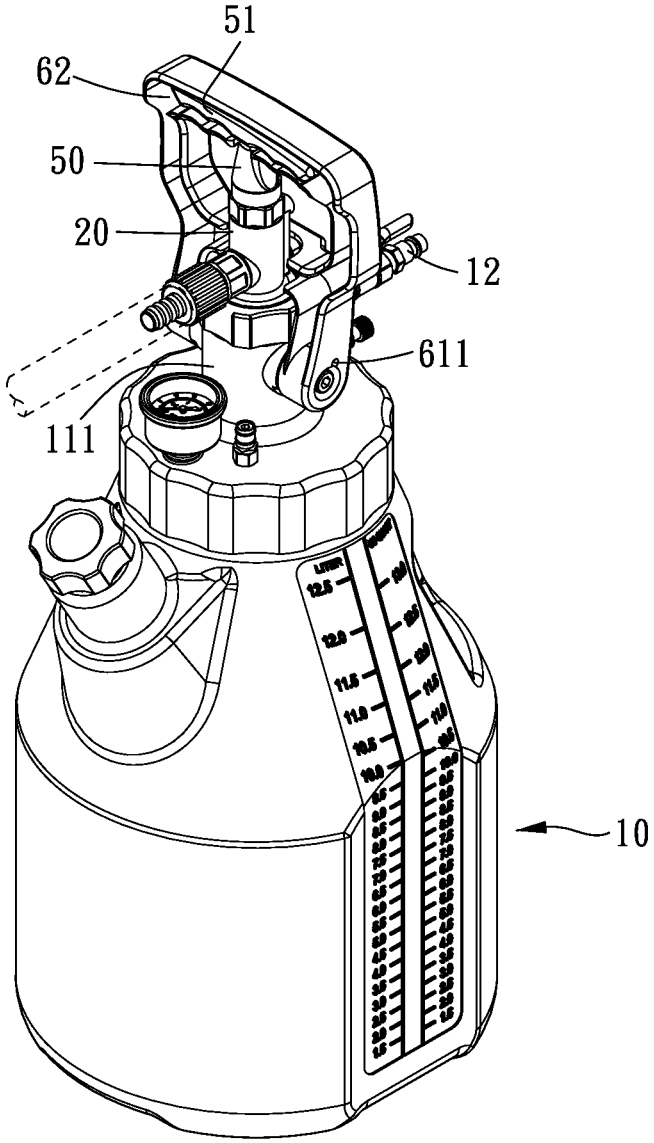
FIG. 3 is a stereogram of the present invention when a positioning handle is located at a first position.
Figure 5:
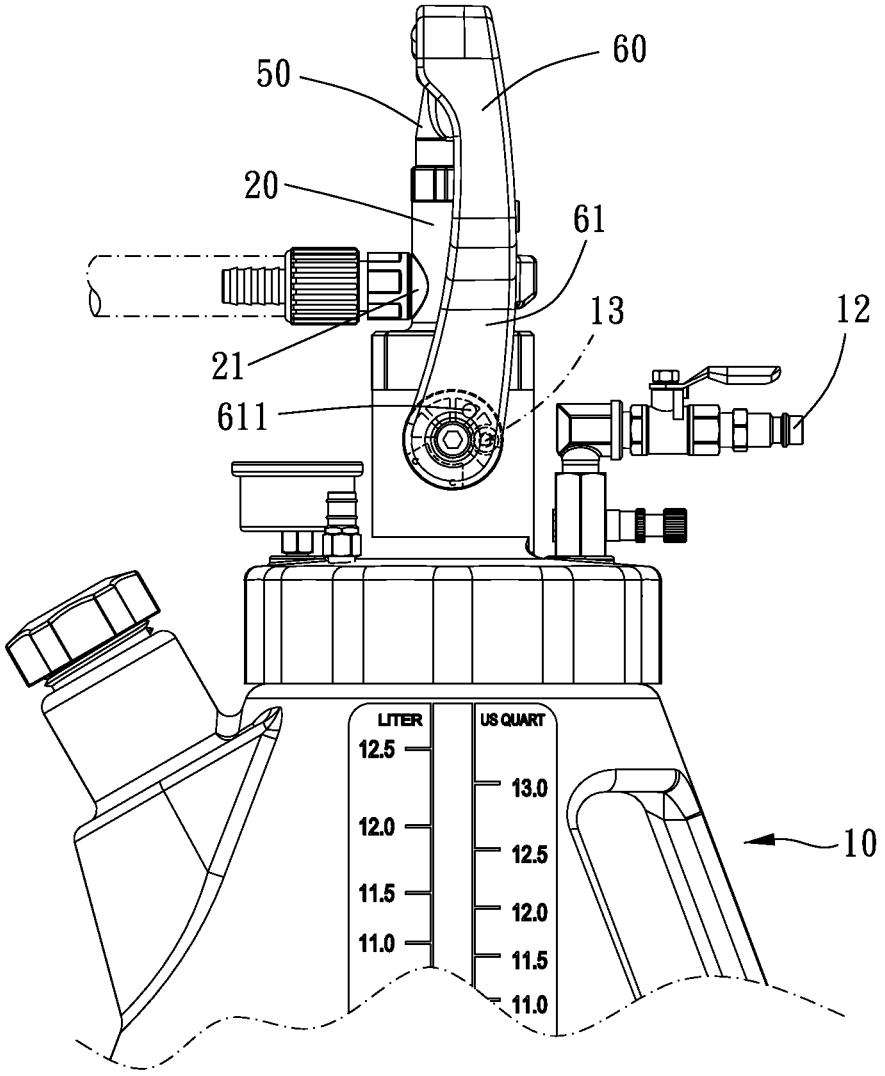
FIG. 5 is an illustration of the present invention when the positioning handle is located at the first position.

As shown in FIGS. 3 and 5, when the positioning handle 60 is located at the first position, the second end of the positioning handle 60 abuts against the end of the pressing rod 50 away from the reservoir 10 so that the pressing rod 50 is unable to move along the inner tube. At this time, the through hole 611 is positionally deviated from the relief hole 13 so that the relief hole 13 does not communicate inside the reservoir 10 and exterior therebetween. More specifically, the handgrip 51 is restricted in the restriction groove 62 and is unable to move, and the through hole 611 does not communicate with the relief hole 13.

Figure 4:
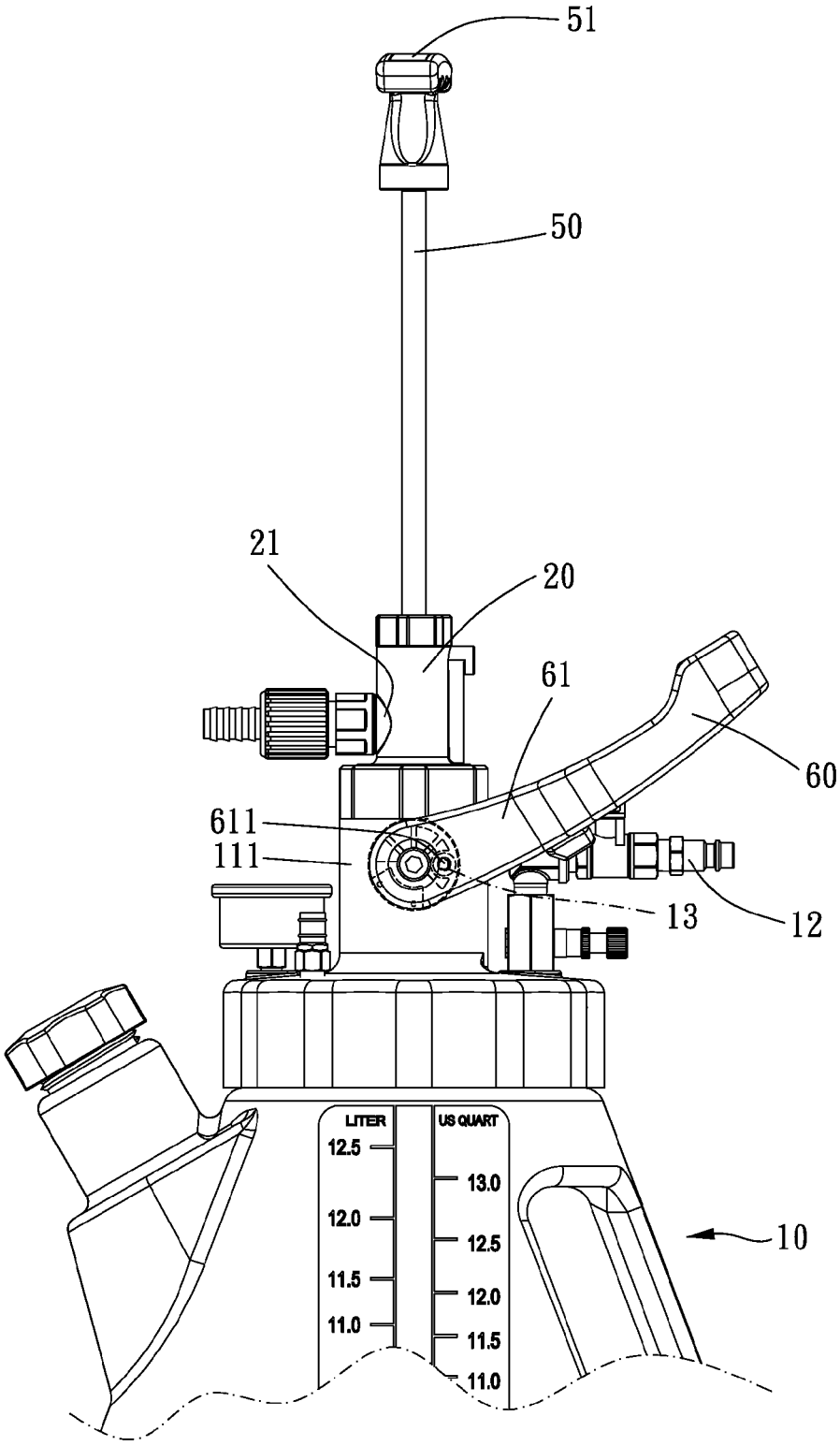
FIG. 4 is an illustration of the present invention when the positioning handle is located at a second position.

As shown in FIGS. 1 and 4, when the positioning handle 60 is located at the second position, the second end of the positioning handle 60 is away from the pressing rod 50 not to abut against the pressing rod 50 so that the pressing rod 50 is able to move along the inner tube. At this time, the through hole 611 positionally corresponds to the relief hole 13 so that the relief hole 13 communicates with exterior via the through hole 611. Specifically, the handgrip 51 leaves the restriction groove 62 so that the pressing rod 50 is able to move up and down, and the through hole 611 communicates with the relief hole 13.

In use, to operate in gas-mode, a user needs to move the positioning handle to the first position to restrict the pressing rod and to block the relief hole, and then gas is filled into the reservoir via the gas inlet to push the fluid in the reservoir to enter the outer tube. Thus, the fluid in the outer tube can be further leave the reservoir via the fluid outlet to be available for injecting to other devices. On the other hand, to operate manually, a user needs to move the positioning handle to the second position to release the pressing rod. The fluid in the reservoir can be sucked into the inner tube when the pressing rod is pulled up, and the fluid in the inner tube can enter the outer tube to further leave via the fluid outlet when the pressing rod is pressed down.

Thereby, the fluid supplying device of the present invention can be operated in gas-mode or manually alternatively and provides a simple mechanism for blocking the relief hole and for preventing the pressing rod from bouncing up at the same time. Even if a user forgets to move the positioning handle to the first position before filling gas into the reservoir, the pressing rod may not bounce up because the relief hole has not been closed. Thus, convenience and safety are both achieved.

What is claimed is:

1. A fluid supplying device, including:

a reservoir, having an opening and a gas inlet, the opening being located at a top of the reservoir, the top of the reservoir further forming a relief hole;

a cover, disposed on the opening of the reservoir and being hollow, a lateral side of the cover forming a fluid outlet;

an outer tube, an end of the outer tube extending into the reservoir, an opposite end of the outer tube extending through the cover, the outer tube communicating with the fluid outlet;

an inner tube, disposed in the outer tube, an end of the inner tube extending into the reservoir;

a pressing rod, slidably disposed in the inner tube, an end of the pressing rod away from the reservoir extending outside the cover;

a positioning handle, an end of the positioning handle being pivotably disposed on the top of the reservoir, the positioning handle being able to pivot between a first position and a second position, the positioning handle further forming a through hole;

wherein when the positioning handle is located at the first position, an end of the positioning handle away from the reservoir abuts against the end of the pressing rod away from the reservoir so that the pressing rod is unable to move along the inner tube, the through hole is positionally deviated from the relief hole so that the relief hole does not communicate inside the reservoir and exterior therebetween;

wherein when the positioning handle is located at the second position, the end of the positioning handle away from the reservoir is away from the pressing rod and does not abut against the pressing rod so that the pressing rod is able to move up and down, the through hole positionally corresponds to the relief hole so that the relief hole communicates with exterior via the through hole.

2. The fluid supplying device of claim 1, wherein an annular flange extending outward is formed at the opening of the reservoir, the relief hole is formed on the annular flange, the positioning handle is pivotably disposed to the annular flange, the cover is disposed at a space enclosed by the annular flange.

3. The fluid supplying device of claim 2, wherein the positioning handle has a first end and a second end, two parallel pivot arms arranged spacedly are formed at the first end, the two pivot arms are pivotably disposed to two opposite sides of the annular flange respectively, the through hole is formed on one of the pivot arms, a restriction groove facing the pressing rod is formed at the second end of the positioning handle, the end of the pressing rod away from the reservoir has a handgrip, when the positioning handle is located at the first position, the handgrip is restricted in the restriction groove and is unmovable, the through hole is deviated from the relief hole and does not communicate with the relief hole.

4. The fluid supplying device of claim 3, wherein circumferential walls of the restriction groove extend to the two pivot arms so that the positioning handle is substantially U-shaped.

5. The fluid supplying device of claim 1, wherein a switch is disposed at the gas inlet to alternatively allow the gas inlet to communicate the reservoir and exterior therebetween.

* * * * *